US008356379B2

(12) United States Patent
Fischer

(10) Patent No.: US 8,356,379 B2
(45) Date of Patent: Jan. 22, 2013

(54) FOLDABLE WIPER PLATE

(75) Inventor: Klaus-Juergen Fischer, Holzappel (DE)

(73) Assignee: Leifheit AG, Nassau/Lahn (DE)

( * ) Notice: Subject to any disclaimer, the term of this patent is extended or adjusted under 35 U.S.C. 154(b) by 1600 days.

(21) Appl. No.: 11/532,303

(22) Filed: Sep. 15, 2006

(65) Prior Publication Data

US 2007/0061985 A1 Mar. 22, 2007

(30) Foreign Application Priority Data

Sep. 16, 2005 (DE) ..... 10 2005 044 509

(51) Int. Cl.
*A47L 13/258* (2006.01)

(52) U.S. Cl. ..... 15/147.2; 15/144.2; 15/229.6; 15/229.8; 15/231

(58) Field of Classification Search ..... 15/144.2, 15/147.1, 147.2, 228, 229.1–229.9, 231
See application file for complete search history.

(56) References Cited

U.S. PATENT DOCUMENTS

| | | | | |
|---|---|---|---|---|
| 5,218,734 | A | 6/1993 | Sacks | |
| 2003/0009839 | A1 * | 1/2003 | Streutker et al. | 15/228 |
| 2003/0167589 | A1 | 9/2003 | Dingert et al. | |
| 2005/0060827 | A1 * | 3/2005 | James et al. | 15/144.2 |

FOREIGN PATENT DOCUMENTS

| | | | |
|---|---|---|---|
| DE | 4011713 | | 10/1991 |
| DE | 29519320 | | 1/1996 |
| DE | 3745013 | | 7/1996 |
| DE | 10210569 | | 9/2003 |
| EP | 426209 | * | 5/1991 |
| EP | 0451443 | | 10/1991 |
| EP | 461684 | * | 12/1991 |
| EP | 1147735 | * | 10/2001 |
| JP | 3-16548 | * | 1/1991 |
| WO | 98/40004 | * | 9/1998 |

* cited by examiner

*Primary Examiner* — Mark Spisich
(74) *Attorney, Agent, or Firm* — Leydig, Voit & Mayer, Ltd.

(57) ABSTRACT

A foldable wiper plate includes a first plate wing pivotable about a first axis, and a second plate wing pivotable about a second axis differing from the first axis. The first plate wing includes a first lock-in device that releasably interlocks the first plate wing with the second axis.

35 Claims, 6 Drawing Sheets

FOLDABLE WIPER PLATE

Priority is claimed to German patent application DE 10 2005 044 509.8-15, filed Sep. 16, 2005.

The present invention relates to a foldable wiper plate with a first plate wing that is pivotable, or swivelable, around a first axis, and this foldable wiper plate has also a second plate wing that is pivotable (or swivelable) around a second axis, differing from the first axis.

BACKGROUND

From the patent document DE 37 45 013 C2, a wiper device holder with two unfoldable wings for incorporating or taking up a wiper system cover is known, whereby the wiper wings are jointed to each other. The two small face or side ends of this wiper system cover have been releasably clamped onto the small face or ends of the respective wing using swiveling bows or clips. In the working position, the two wings are positioned on one level. In order to form a lock-in, or catch, connection in the working position, one of the lock-in connections has a projecting nose which engages, or becomes interlocked, with the locking, or stopping, projection of the other wing. For releasing the lock-in connection, a latch has been provided through which the locking projection can be pivoted or swiveled away from the locking, or stopping, edge. Also from DE 102 10 569 A1, a two-parted foldable wiper plate is known with essentially the same structure or configuration.

A drawback of these already known foldable wiper plates is that the lock-in connection serving as the work position can only be achieved through great effort and skillfulness as well as high pressure onto the stick carrying the wiper plate. It is particularly disadvantageous that for unfolding the plate wing, as a rule, the wiper has to be lifted up with the stick so that the two wiper plates might fall to the ground owing to their balancing weight or load. This, however, is made considerably more difficult due to the fact that this operation has to be done simultaneously with foot-operating the release latch, or lever. In doing so, the load direction of the latch for releasing the lock-in connection is precisely in the opposite direction to the traction force, or power pull, direction of the stick which is required for the lifting-up operation as well as for effecting the unfolding operation. The user has to be very skilled in order to press simultaneously the lever, located on a wiper plate downward and to lift or to pull simultaneously the wiper plate up with the stick. If the user exerts too much pressure with the foot, it will not be possible to lift or to pull the wiper plate up with the stick. If the user exerts too little pressure onto the release lever, then the wiper plate can be lifted or pulled up with the stick, however, then the lock-in connection will not be released, or disengaged. Even if the user is skillful enough to master the difficult release operation, this operation will be considered strenuous and power- and time-consuming.

From DE 40 11 713 A1, a foldable wiper plate is known, in which the wiper plates in the working position are not locked-in to one another, or have not become interlocked with one another, but in which these plates are locked-in on a central part that is jointed to the wiper plates. Also here, a release latch or lever has been provided which for releasing the lock-in connection has to be pressed downward, while simultaneously, the wiper plate has to be lifted or pulled in an upward direction with the stick that is affixed to the plate. This foldable wiper plate has the same drawbacks as the two wiper plates already mentioned above.

SUMMARY

Therefore, it is an object of the present invention to provide a foldable wiper plate which, on the one hand, can be released, or disengaged, and can be unfolded in an easy and reliable manner, and which, on the other hand, ensures reliable, releasable locking-in of the unfolded position.

In an embodiment, the present invention provides a foldable wiper plate including a first plate wing pivotable about a first axis, and a second plate wing pivotable about a second axis differing from the first axis. The first plate wing includes a first lock-in device configured to releasably interlock the first plate wing with the second axis.

BRIEF DESCRIPTION OF THE DRAWINGS

The present invention is elaborated upon below based on an exemplary embodiment with reference to the drawings. Similar elements are referred to with the same reference numbers. The following are shown.

DETAILED DESCRIPTION

Figure 1:
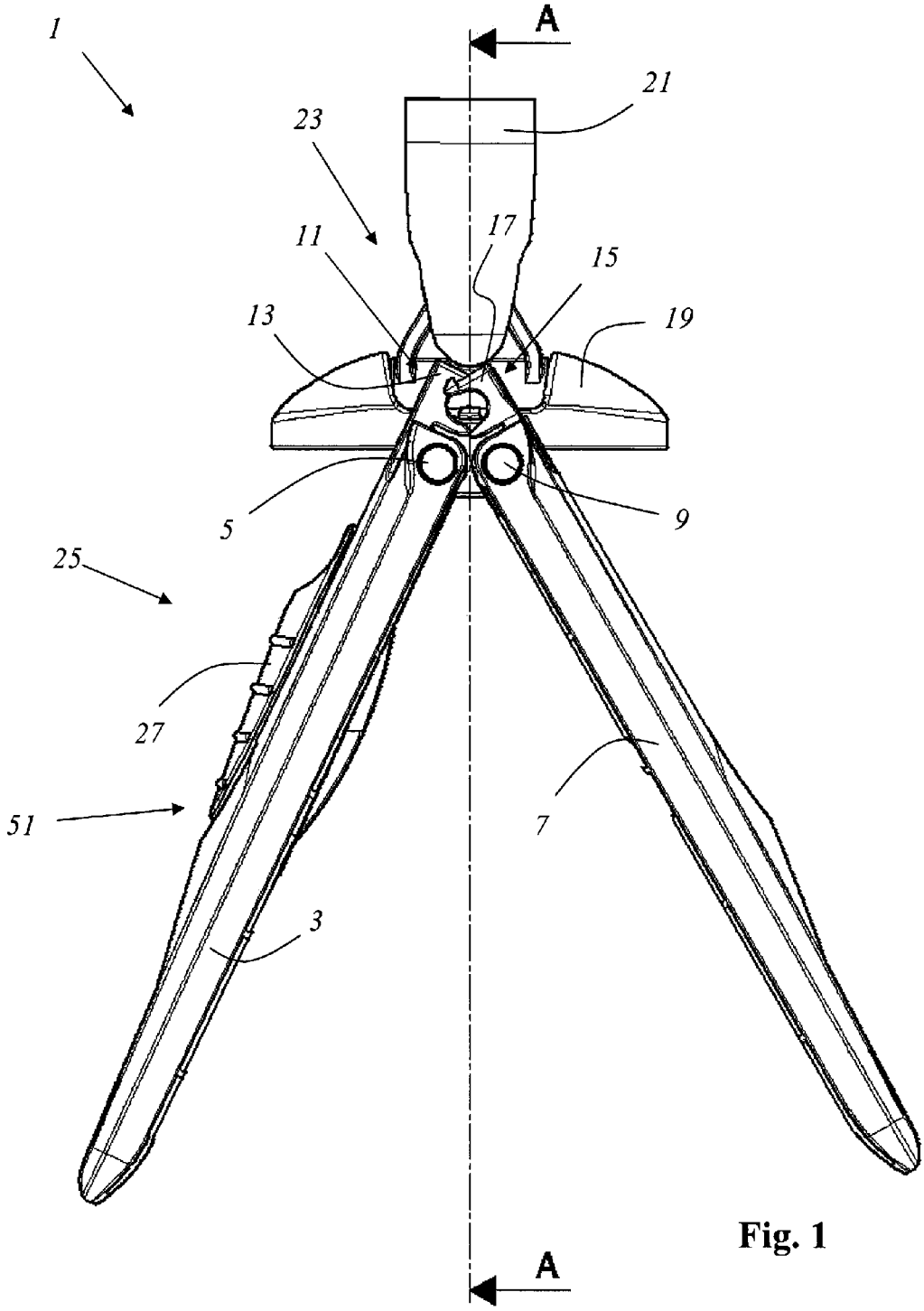
FIG. 1 a side view of the foldable wiper plate in accordance with the invention, in a folded position.

In accordance with the invention, reliable and easy locking, or stopping, of the plate wings in the working position can be achieved by means of locking-in a plate wing to the axis of the other plate wing. Furthermore, such a locked-in connection can be released, or disengaged, in a particularly easy way.

In an embodiment of the foldable wiper plate, a holding element is provided, on which the first axis and the second axis are arranged.

In an embodiment, the second plate wing has a second lock-in, or catch, means through which the second plate can be locked-in, or interlocked, with the first axis.

In an embodiment of the foldable wiper plate that can be interlocked in a particularly safe way, the first lock-in means has at least a first lock-in nose which in the interlocked position is pressed from the second plate wing against the second axis thus supporting the lock-in connection. Similarly, the embodiment may advantageously include that the second lock-in means has a second lock-in nose that, advantageously, in the interlocked position, is pressed by means of the first plate wing against the first axis to ensure reinforcement of the interlocked connection.

In an embodiment of the foldable wiper plate, the first lock-in means at least partly surrounds the second axis in the interlocked position of the wiper plate. Furthermore, the embodiment may advantageously include that the second lock-in means at least partly surrounds the first axis in the interlocked position of the wiper plate.

An embodiment of the foldable wiper plate provides a release device serving to disengage the interlocked connection of the first plate wing and/or to disengage or release the second plate wing. The release device may be configured on and/or in a plate wing.

In an embodiment, the release device has a release lever, for example a foot-operated pedal. The release lever may be advantageously configured on a plate wing and/or in a plate wing to ensure convenient pivoting and/or swiveling. The release pedal is formed in such a way that it can be optionally changed to an interlocked position or also to a releasing, or disengaging, position.

In an embodiment of the foldable wiper plate, the release lever can be temporarily locked in the release position. For this purpose, a third lock-in device, for example, may be provided to ensure temporary locking of the release lever in the release position. An advantage of this embodiment is that after activation of the release lever, the wiper plate—for example, if it has been affixed on a stick—through lifting up of the stick, the plate automatically falls into the folding, or unfolding, position, irrespective of whether the user keeps the release lever pressed or not. An advantage hereby is that for folding up and opening out of the plate wings, the user does not have to lift up the wiper plate with the stick while at the same time having to operate and to press the foot pedal. Instead, the user can first operate the release pedal, and then fold up and open out the wiper plate safely and reliably without having to stand and balance on one leg. A further embodiment may include that the temporary locking of the release lever be released automatically in case the foldable wiper plate has been changed to the working position. This can be achieved, for example, through a projecting part which releases, or separates, the third lock-in means when attaining the working position.

In an embodiment, the release device has a tilting, or rocker-type, device. Preferably, an arm of the tilting device can be swiveled against the holding element in order to release the locking-in. Furthermore, an advantageous embodiment may provide that an arm of the tilting device can be locked-in to, for instance, a wiper plate to enable temporary locking and stopping of the release lever, while the other arm of the release lever serves for releasing the locking-in.

In an embodiment of the foldable wiper plate, the first plate wing, including the release device parts which this wing carries, is of the same weight as the second plate wing, including the release device parts which this second wing carries. This embodiment has the advantage that the wiper plate here can be used particularly well in a wiper-cloth drying device which spins the wiper-cloth by rotation according to the principle of a spin-drying, or a tumbler-dryer, system, as there will be no unbalanced mass.

The foldable wiper plate in accordance with the invention may, for instance, be part of a cleaning device, or a cleaning system, with a stick and/or a handle.

In an advantageous embodiment of the cleaning device, the wiper plate and the stick are jointed to one another. The jointed connection may, for instance, be configured as a cardanic, or gimbal, connection.

In an embodiment, the jointed connection can be releasably locked-in. This embodiment is advantageous for the cleaning device's use in combination with a spin-drying device or system as hereby, owing to the locked connection, the hazard of any uncontrolled swaying or deflecting during the spinning operation will be avoided. For the releasable locking of the jointed connection, a locking and catching device may be provided. In an embodiment, this locking and catching device has a lock-in projection, in particular a lock-in nose. Advantageously, in this embodiment the locking and catching device may have a spring mechanism, thus providing the lock-in projection with spring tension and power capability. Such a cleaning device where the locking and catching device and/or the lock-in projection and/or the spring mechanism are one piece with the pivotable part of the jointed connection of the wiper plate and stick may be inexpensively and efficiently manufactured.

FIG. 1 shows a foldable wiper plate 1 with a first plate wing 3 pivotably positioned around the first axis 5. The foldable wiper plate 1 has a second plate wing 7 pivotably positioned around the second axis 9—differing from the first axis. The first plate wing 3 has a first lock-in means 11 that is configured as a first link-in nose 13. The first plate wing 3 can be releasably interlocked, via the first lock-in means 11, with the second axis 9. The second plate wing 7 has a second link-in means 15 that is configured as a second link-in nose 17. The second plate wing 7 can be releasably interlocked, via the second lock-in means 15, with the first axis 5. The first axis 5 and the second axis 9 are jointly positioned on the holding element 19. The foldable wiper plate 1 has an insertion opening for the wiper stick, which is jointed to the holding element 19. The jointed connection is configured as a cardanic connection 23. The first plate wing 3 has a release lever 25 which is formed as a foot-operated pedal 27. The release lever 25 is configured as a tilting device (see FIG. 6) and in the shown position of the foldable wiper plate is temporarily locked through a third lock-in means 51. The functioning of the release lever 25 is shown in the FIGS. 6 and 7.

Figure 2:
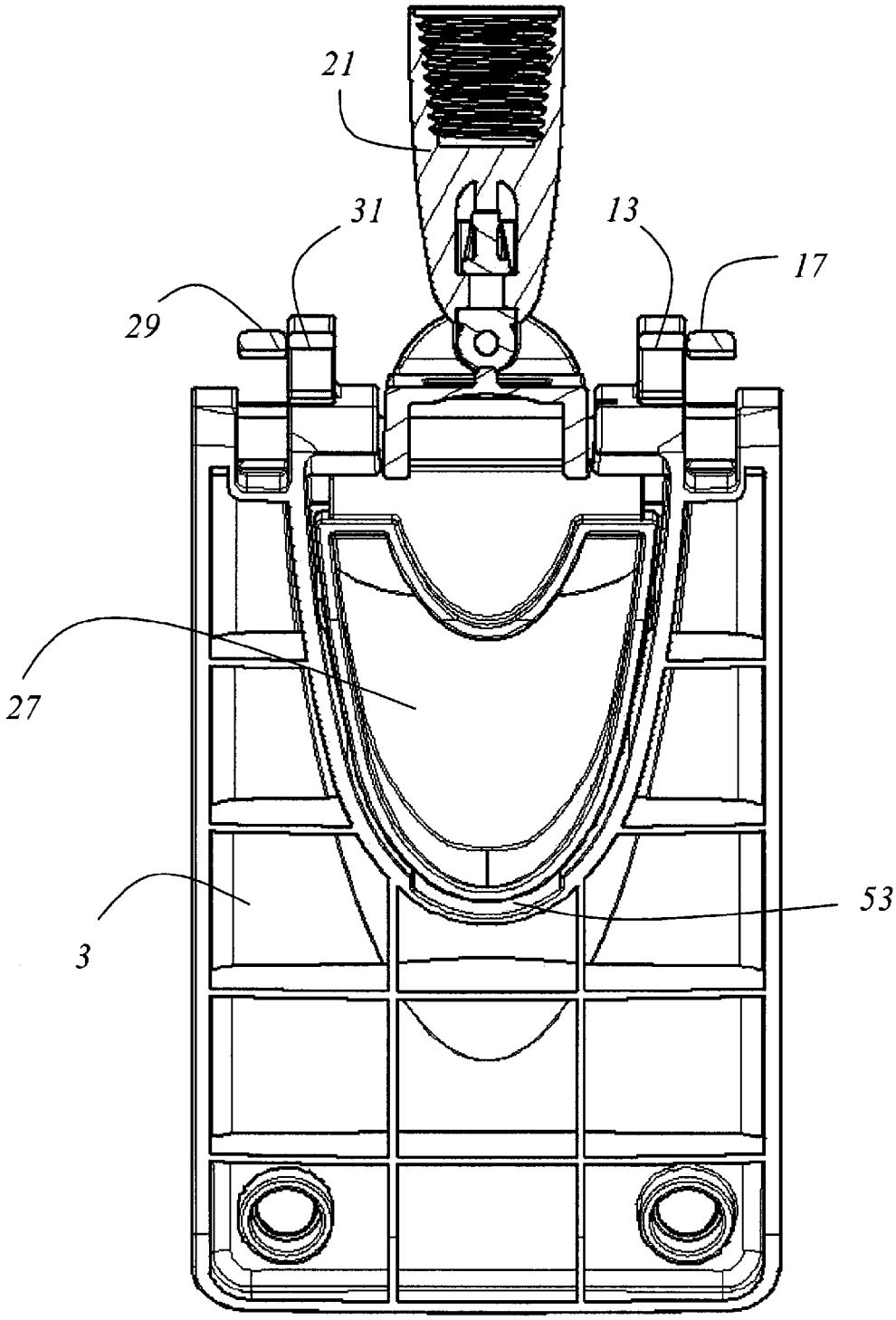
FIG. 2 a cross-sectional view of the foldable wiper plate in accordance with the invention.

FIG. 2 provides a cross-sectional view of the foldable wiper plate in accordance with the invention, whereby the intersection line of the cross-sectional view is designated A in FIG. 1. It can be seen that the foldable wiper plate has, along with the first lock-in nose 13, another lock-in nose 31. Similarly, the second plate wing has, along with the second lock-in nose 17, another second lock-in nose 29. The other first lock-in nose 31 serves for interlocking the first plate wing with the second axis. Similarly, the other second lock-in nose 29 serves for interlocking the second plate wing 7 with the first axis 5.

Figure 3:
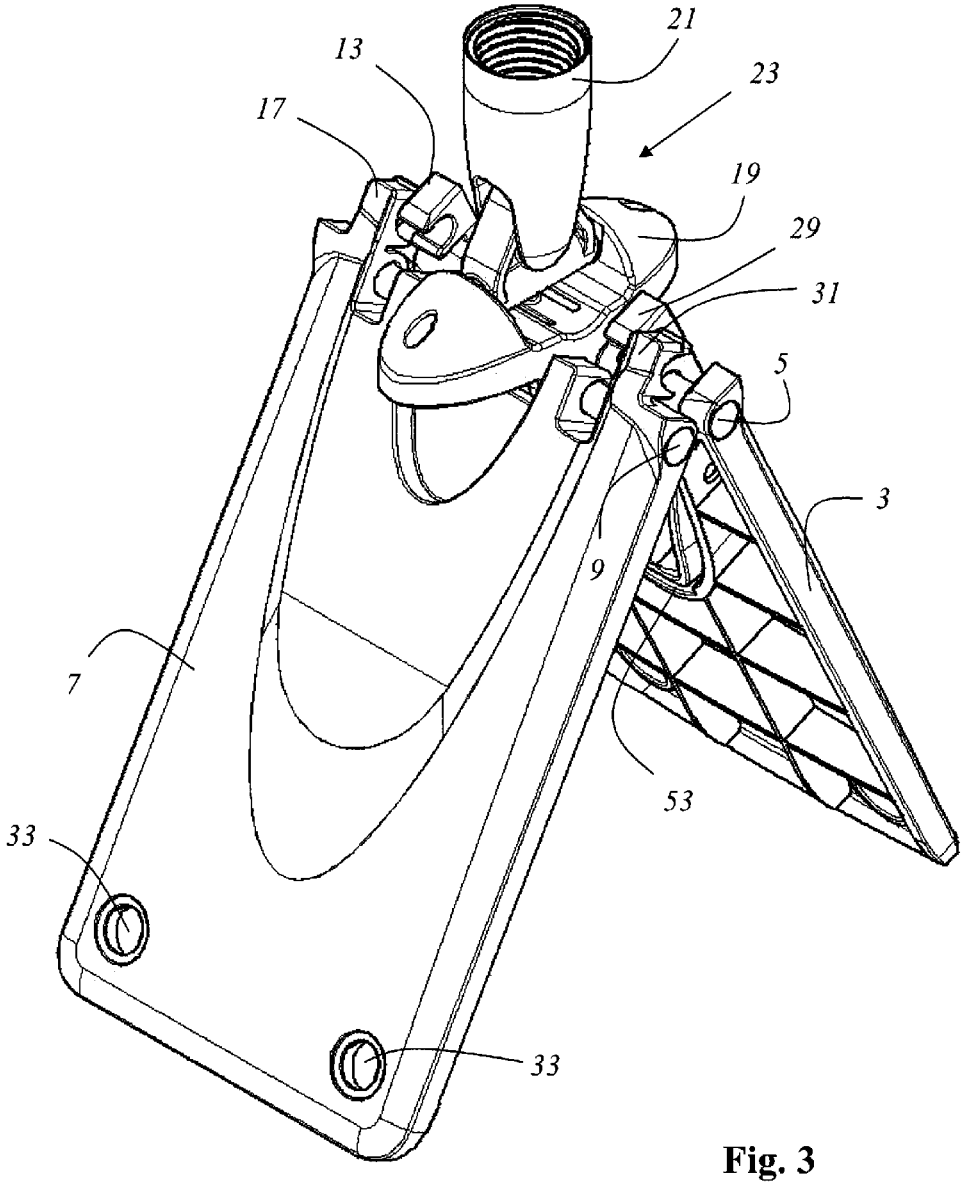
FIG. 3 a perspective view of the foldable wiper plate in accordance with the invention.

FIG. 3 provides a perspective view of the foldable wiper plate in accordance with the invention. The cardanic connection 23 between the holding element 19 and the stick insertion opening 21 can be seen. The first plate wing 3 and the second plate wing 7 have eyelets 33 for attaching a wiping-cloth.

Figure 4:
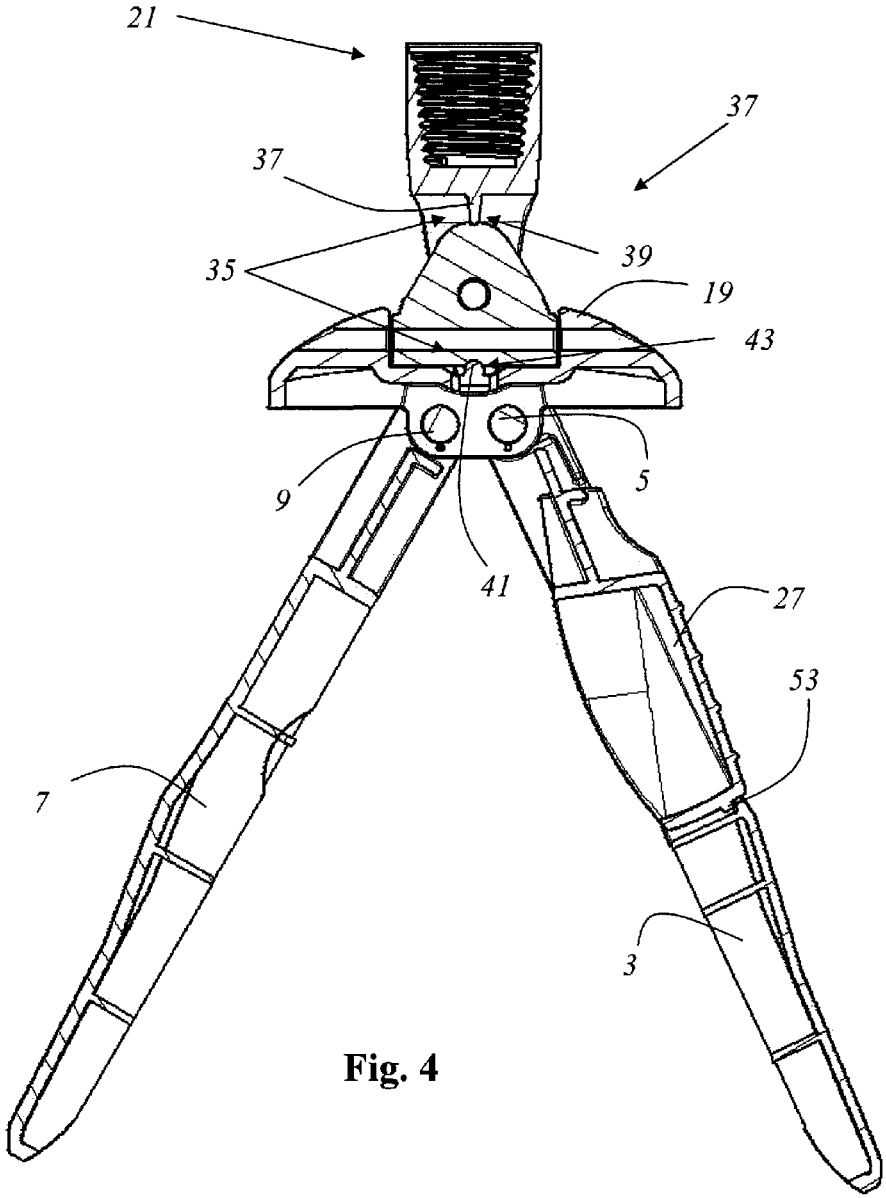
FIG. 4 another cross-sectional view of the foldable wiper plate in accordance with the invention.

FIG. 4 provides a cross-sectional longitudinal view of the foldable wiper plate in accordance with the invention. Here the structure of the holding element 19 can be seen particularly well; this element holds the first axis 5 and the second axis 9 around which the first plate wing 3 and the second plate wing 7, respectively, are pivotably arranged. Shown is also the cardanic connection 23 which can be temporarily and releasably locked in a central position using the locking means 35. This locking means 35 has a first spring-nose 37 which engages with the notch 39. Furthermore, the locking means 35 has another spring-nose 41 which engages with a further notch 43. The first spring-nose 37 is manufactured in one piece with the stick insertion opening 21. The second-spring nose 41 is manufactured in one piece with the holding element 19.

Figure 5:
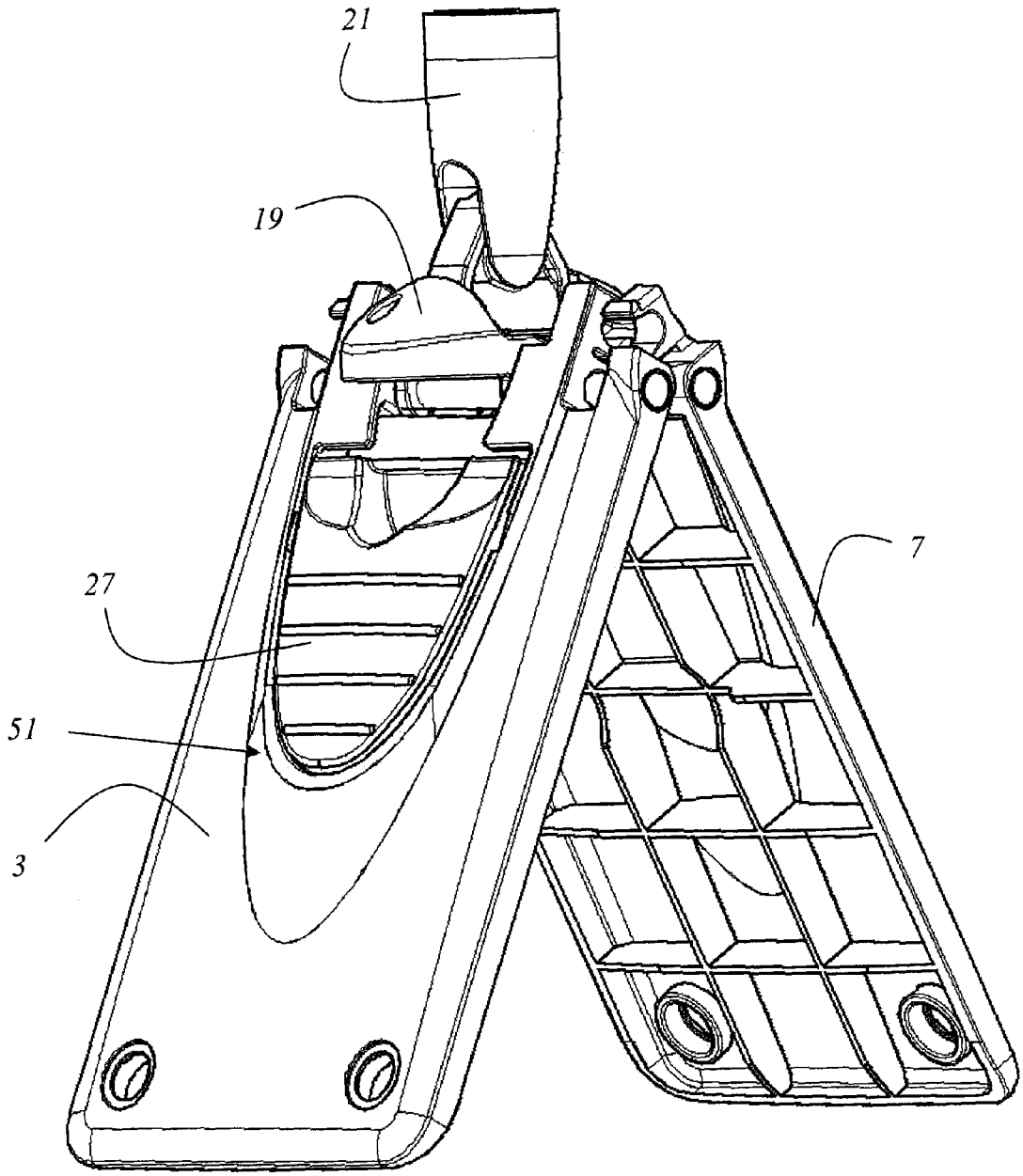
FIG. 5 another perspective view of the foldable wiper plate in accordance with the invention.

Similarly to FIG. 3, FIG. 5 provides a perspective view of the foldable wiper plate in accordance with the invention, however, from the other side.

Figure 6:
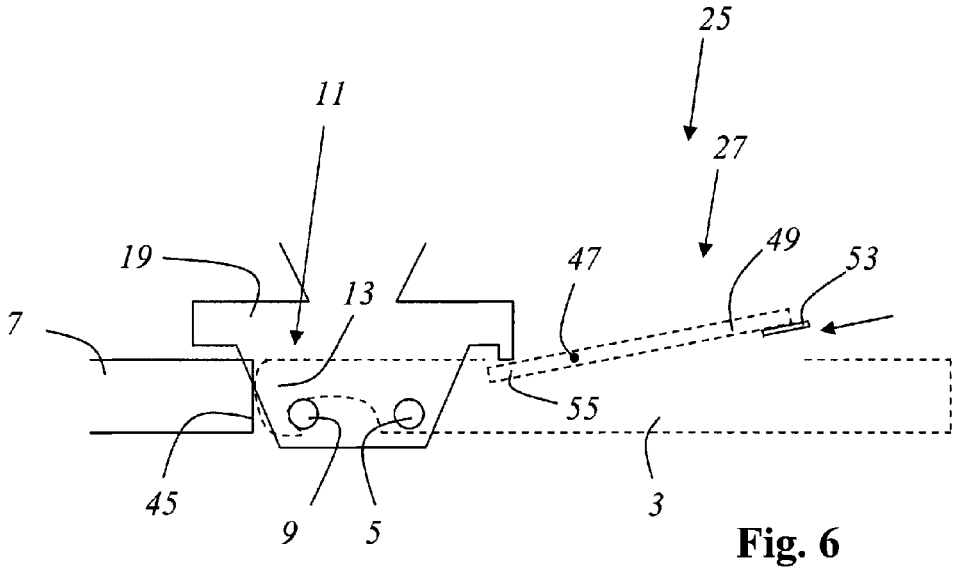
FIG. 6 a schematic detailed view of the foldable wiper plate in accordance with the invention, in the locked-in position (working position)

FIG. 6 provides a detailed schematic view of the foldable wiper plate in accordance with the invention. A holding element 19 is shown which carries first axis 5 and second axis 9. First plate wing 3 is pivotably positioned around the first axis 5. The first plate wing 3 has first lock-in means 11 which incorporates the lock-in nose 13. In the shown interlocked position, the lock-in nose 13 of the first plate wing 3 can be releasably interlocked with the second axis 9. The second plate wing 7 is pivotably positioned around the second axis 9 and presses its front face 45 against the first lock-in nose 13, thus supporting the interlocked position. To disengage the lock-in connection, the release lever 25 is provided which includes foot-operated pedal 27. The release lever 25 is configured as a tilting device pivotably positioned around pivot axis 47. The foot-operated pedal 27 includes first and second tilting arms 49 and 55, respectively. The first tilting arm 49 has a third lock-in device 51. The third lock-in device 51 includes a lock-in nose 53 with which the release lever can be releasably locked into place. The lock-in nose 53 is configured in such a way that, when the release lever 25 is pressed downward, it locks into place behind the edge of the first wiper plate 3 in which the tilting device is positioned. During the release operation, that is, when the first tilting device arm 49 is pressed downward, the second tilting arm 55 is swiveled against the holding element 19, thereby releasing the interlocking of the wiper plates.

Figure 7:
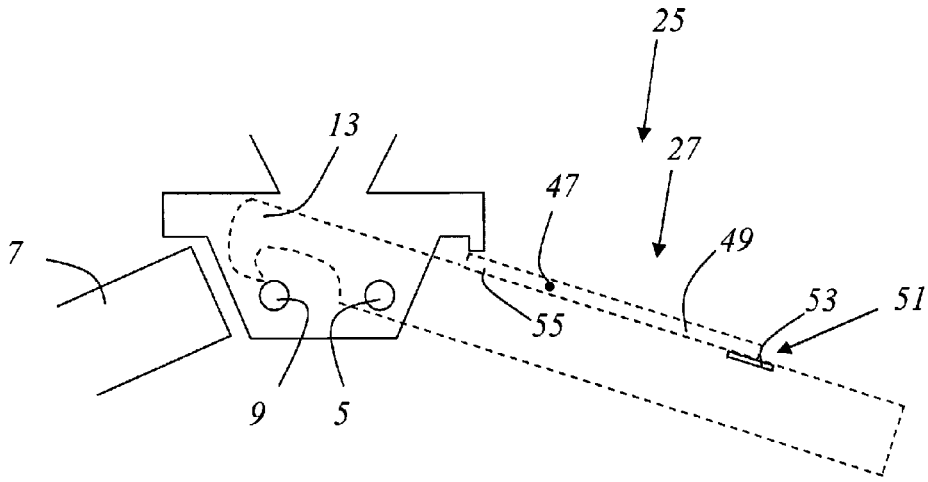
FIG. 7 a schematic detailed view of the foldable wiper plate in accordance with the invention, after release of the interlocked connection.

FIG. 7 shows the foldable wiper plate in accordance with the invention just after release of the interlocked connection. As can be seen, due to the temporary locking of the release lever 25, there is no danger of the wiper plate falling back again into the interlocked position by itself. Consequently, the user must press the holding element 19 downward against the floor, for instance using the stick; so as to automatically release the interlocked connection of the release lever 25.

The invention has been described with regard to a specific embodiment. It is obvious, however, that changes and modifications/alterations can be made without hereby leaving the range of protection of the following claims.

What is claimed is:

1. A foldable wiper plate comprising:

a first plate wing pivotable about a first axis member; and a second plate wing pivotable about a second axis member differing from the first axis member;

wherein the first plate wing includes a first lock-in device configured to engage the second axis member so as to releasably interlock the first plate wing with the second axis member.

2. The foldable wiper plate as recited in claim 1 wherein the first axis member and the second axis member are disposed on a joint holding element.

3. The foldable wiper plate as recited in claim 1 wherein the second plate wing includes a second lock-in device configured to releasably interlock the second plate wing with the first axis member.

4. The foldable wiper plate as recited in claim 3 wherein the second lock-in device includes a second lock-in nose.

5. The foldable wiper plate as recited in claim 4 wherein, in an interlocked position, the second lock-in nose is configured to press against the first axis member.

6. The foldable wiper plate as recited in claim 3 wherein the second lock-in device is configured to at least partially surround the first axis member in an interlocked position of the wiper plate.

7. The foldable wiper plate as recited in claim 1 wherein the first lock-in device includes a first lock-in nose.

8. The foldable wiper plate as recited in claim 7 wherein, in an interlocked position, the first lock-in nose is configured to press against the second axis member.

9. The foldable wiper plate as recited in claim 1 wherein the first lock-in device is configured to at least partially surround the second axis member in an interlocked position of the wiper plate.

10. The foldable wiper plate as recited in claim 1 further comprising a release device configured to release an interlocking of the first plate wing with the second axis member.

11. The foldable wiper plate as recited in claim 10 wherein the release device is disposed on the first or second plate wing.

12. The foldable wiper plate as recited in claim 10 wherein the release device includes a release lever.

13. The foldable wiper plate as recited in claim 12 wherein the release lever includes a foot-operated pedal.

14. The foldable wiper plate as recited in claim 12 wherein the release lever is pivotably disposed on the first or second plate wing.

15. The foldable wiper plate as recited in claim 12 wherein the release lever is selectably positionable to an interlocking position and to a release position.

16. The foldable wiper plate as recited in claim 12 wherein the release lever is temporarily lockable in a release position.

17. The foldable wiper plate as recited in claim 16 further comprising a third lock-in device configured to temporarily lock the release lever in the release position.

18. The foldable wiper plate as recited in claim 10 wherein the release device includes a tilting device.

19. The foldable wiper plate as recited in claim 18 wherein the first axis member and the second axis member are disposed on a joint holding element, and wherein the tilting device includes an arm configured to swivel towards the holding element so as to release the interlocking of the first plate wing with the second axis member.

20. The foldable wiper plate as recited in claim 1 further comprising an insertion opening configured to receive a stick.

21. The foldable wiper plate as recited in claim 20 wherein the first axis member and the second axis member are disposed on a joint holding element, and wherein the insertion opening is jointedly connected to the holding element.

22. The foldable wiper plate as recited in claim 21 wherein the insertion opening is cardanically connected to the holding element.

23. The foldable wiper plate as recited in claim 1 further comprising a first release device disposed on the first plate wing and a second release device disposed on the second plate wing, the first plate wing and the first release device together having a same weight as the second plate wing and the second release device together.

24. The foldable wiper plate as recited in claim 1 wherein the wiper plate is configured to attachably receive a wiping-cloth.

25. A cleaning device comprising:

a foldable wiper plate as recited in claim 1; and a stick connected to the wiper plate.

26. The cleaning device as recited in claim 25 wherein the stick is jointedly connected to the wiper plate.

27. The cleaning device as recited in claim 25 wherein the stick is cardanically connected to the wiper plate.

28. The cleaning device as recited in claim 26 wherein the stick is jointedly connected to the wiper plate in a releasably lockable fashion.

29. The cleaning device as recited in claim 28 further comprising a lock-in device configured to lock-in a connection of the wiper plate and the stick.

30. The cleaning device as recited in claim 29 wherein the lock-in device includes a lock-in projection.

31. The cleaning device as recited in claim 30 wherein the lock-in projection includes a lock-in nose.

32. The cleaning device as recited in claim 30 wherein the lock-in device includes a spring mechanism configured to provide the lock-in projection with spring tension.

33. The cleaning device as recited in claim 29 wherein the lock-in device is unitary with a jointed part of the connection of wiper plate and the stick.

34. A cleaning system comprising:

a foldable wiper plate as recited in claim 1; and a spin-drying device associated with the foldable wiper plate.

35. A cleaning system comprising:

a foldable wiper plate as recited in claim 1;

a stick connected to the wiper plate; and a spin-drying device connected to the foldable wiper plate.

* * * * *